US010280919B2

(12) United States Patent
Kerr et al.

(10) Patent No.: US 10,280,919 B2
(45) Date of Patent: May 7, 2019

(54) PUMP CASING

(71) Applicant: TSC Manufacturing and Supply, LLC, Houston, TX (US)

(72) Inventors: David Kerr, Houston, TX (US); Ian Haas, Houston, TX (US)

(73) Assignee: TSC MANUFACTURING AND SUPPLY, LLC, Houston, TX (US)

( * ) Notice: Subject to any disclaimer, the term of this patent is extended or adjusted under 35 U.S.C. 154(b) by 66 days.

(21) Appl. No.: 15/634,856

(22) Filed: Jun. 27, 2017

(65) Prior Publication Data

US 2017/0363081 A1 Dec. 21, 2017

Related U.S. Application Data

(63) Continuation of application No. 14/841,856, filed on Sep. 1, 2015, now Pat. No. 9,702,359.

(51) Int. Cl.

| | |
|---|---|
| ***F04B 53/16*** | (2006.01) |
| ***F04B 1/16*** | (2006.01) |
| ***F04B 53/00*** | (2006.01) |
| ***F04B 53/14*** | (2006.01) |
| ***E21B 43/12*** | (2006.01) |
| ***F04B 1/04*** | (2006.01) |
| ***F04B 47/02*** | (2006.01) |

(52) U.S. Cl.

CPC ..... *F04B 53/16* (2013.01); *E21B 43/121* (2013.01); *F04B 1/0421* (2013.01); *F04B 1/16* (2013.01); *F04B 47/02* (2013.01); *F04B 53/006* (2013.01); *F04B 53/14* (2013.01); *F04B 53/144* (2013.01)

(58) Field of Classification Search

CPC ..... F04B 39/121; F04B 53/16; F04B 53/22

See application file for complete search history.

(56) References Cited

U.S. PATENT DOCUMENTS

| | | | | |
|---|---|---|---|---|
| 2,239,853 | A | 4/1941 | Louree | |
| 4,477,237 | A * | 10/1984 | Grable | F04B 53/00 417/454 |
| 4,553,298 | A * | 11/1985 | Grable | F04B 9/02 227/152 |
| 5,479,847 | A | 1/1996 | Powers et al. | |
| 8,721,300 | B2 * | 5/2014 | Schuetzle | F04B 1/0404 417/273 |
| 9,702,359 | B2 * | 7/2017 | Kerr | F04B 53/16 |
| 2010/0158727 | A1 | 6/2010 | Hawes et al. | |
| 2010/0322802 | A1 * | 12/2010 | Kugelev | F04B 53/147 417/437 |
| 2013/0177454 | A1 * | 7/2013 | Schuetzle | F04B 1/0404 417/271 |

* cited by examiner

*Primary Examiner* — Thomas E Lazo
(74) *Attorney, Agent, or Firm* — Hauptman Ham, LLP

(57) ABSTRACT

A new pump design is described. The pump features a casing with a continuous enclosure extending from a power end of the casing to a fluid end of the casing for housing the reciprocating assembly of the pump, which includes a crankshaft, a plurality of control rods coupled to the crankshaft, and a plurality of crossheads coupled to the control rods. A detachable lid is attached to the casing at the power end and the fluid end of the casing, and encloses the reciprocating assembly. An alignment plate oriented substantially parallel to a stroke axis of the pump maintains alignment of the crossheads.

20 Claims, 6 Drawing Sheets

PUMP CASING

CROSS-REFERENCE TO RELATED APPLICATIONS

This application is a continuation of U.S. patent application Ser. No. 14/841,856 filed Sep. 1, 2015, which is incorporated herein by reference.

FIELD

Embodiments described herein relate to pumps for oilfield applications. More specifically, the embodiments described herein relate to pump designs having improved access to internal parts.

BACKGROUND

Production of oil and gas is a trillion dollar industry. Producers continually seek ways to increase the speed and flexibility, and lower the cost of, production apparatus for onshore and offshore oil and gas production. Equipment downtime is costly, so efficient repair and replacement of equipment in the field is valuable.

Reciprocating pumps are used in the oil industry for many purposes. In one type of pump, a crankshaft turns inside a casing, and control rods couple to the crankshaft to drive one or more crossheads in a reciprocating motion to pump a fluid. In conventional pump designs, to remove any of the control rods and crossheads from the pump, the crankshaft must also be removed. This adds costly time to any repair or maintenance of the control rods and crossheads. There is a need for a pump design that enables fast access and servicing of pump components without removing the crankshaft.

SUMMARY

Embodiments disclosed herein provide a pump with a reciprocating assembly comprising a crankshaft, a plurality of control rods coupled to the crankshaft, and a plurality of crossheads coupled to the control rods, wherein the stroke of the crossheads define an axis of the pump, and the crankshaft is disposed substantially perpendicular to the axis of the pump; a casing with a continuous enclosure extending from a power end of the casing to a fluid end of the casing for housing the reciprocating assembly; and a detachable lid that fastens to the casing at the power end and at the fluid end.

Other embodiments described herein provide a pump with a reciprocating assembly comprising a crankshaft, a plurality of control rods coupled to the crankshaft, and a plurality of crossheads coupled to the control rods, wherein the stroke of the crossheads define an axis of the pump, and the crankshaft is disposed substantially perpendicular to the axis of the pump; a casing with a continuous enclosure extending from a power end of the casing to a fluid end of the casing for housing the reciprocating assembly; a detachable lid that fastens to the casing at the power end and at the fluid end; and an alignment plate that fastens to the casing in an orientation substantially parallel to the axis of the pump, wherein the alignment plate has a curved alignment surface for each crosshead.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
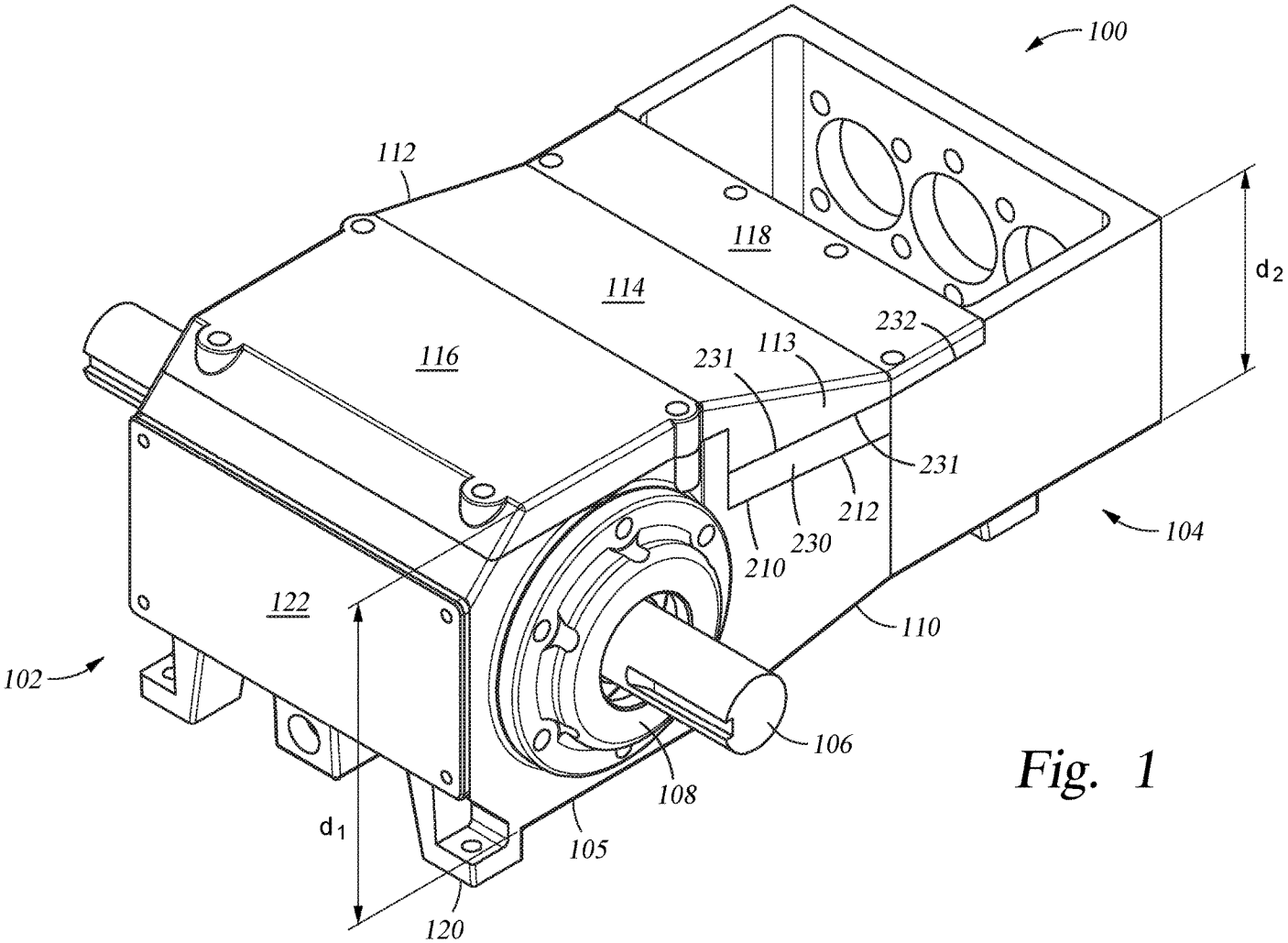
FIG. 1 is a perspective view of a pump 100 according to one embodiment.

FIG. 1 is a perspective view of a pump 100 according to one embodiment. The pump 100 is a high pressure pump that may be used for pumping fluids in an oil production operation or an oil and gas drilling operation. For example, the pump 100 may be used to pump crude oil or drilling fluids.

The pump 100 has a power end 102 and a fluid end 104. The power end 102 features a crankcase 105 in which a crankshaft 106 is disposed for operation. The crankshaft 106 may be removed from the crankcase 105 for maintenance. A bearing assembly 108 positions and controls the crankshaft 106, which protrudes through the bearing assembly 108 outside the crankcase 105 for power coupling.

The pump 100 has a casing 110 that partially encloses the operating components of the pump 100, including the crankshaft 106 and control rods and crossheads shown in other figures and described below in more detail. The casing extends from the power end 102 to the fluid end 104, and has a generally rectangular profile. The casing has a depth $d_1$ at the power end 102 that accommodates the crankshaft 106 and transitions to a depth $d_2$ at the fluid end 104 that accommodates connection to a fluid coupling (not shown). The depth $d_1$ is larger than the depth $d_2$ in the embodiment of FIG. 1, but is not necessarily so.

The pump 100 has a detachable lid 112 that covers and encloses the operating components of the pump 100. The detachable lid 112 fastens to the casing 110 at the power end 102 and near the fluid end 104, and along the sides 113 of the lid 112. The lid 112 has an angled portion 114 that connects a first portion 116 of the lid that encloses the crankcase 105 with a second portion 118 of the lid that attaches to the casing 110 near the fluid end 104, such that the first portion 116 and the second portion 118 are non-coplanar. The second portion 118 may be a flange that provides only connection to the casing 110 at the fluid end, or the second portion 118 may be a cover portion that encloses the stroke area of the crossheads, depending on the extent of the second portion 118. The pump 100 has optional mounts 120 that may be used to affix or secure the pump 100 to another support. An end plate 122 provides access to the operating cavity of the pump 100 through the casing 110 at the power end 102.

Figure 2:
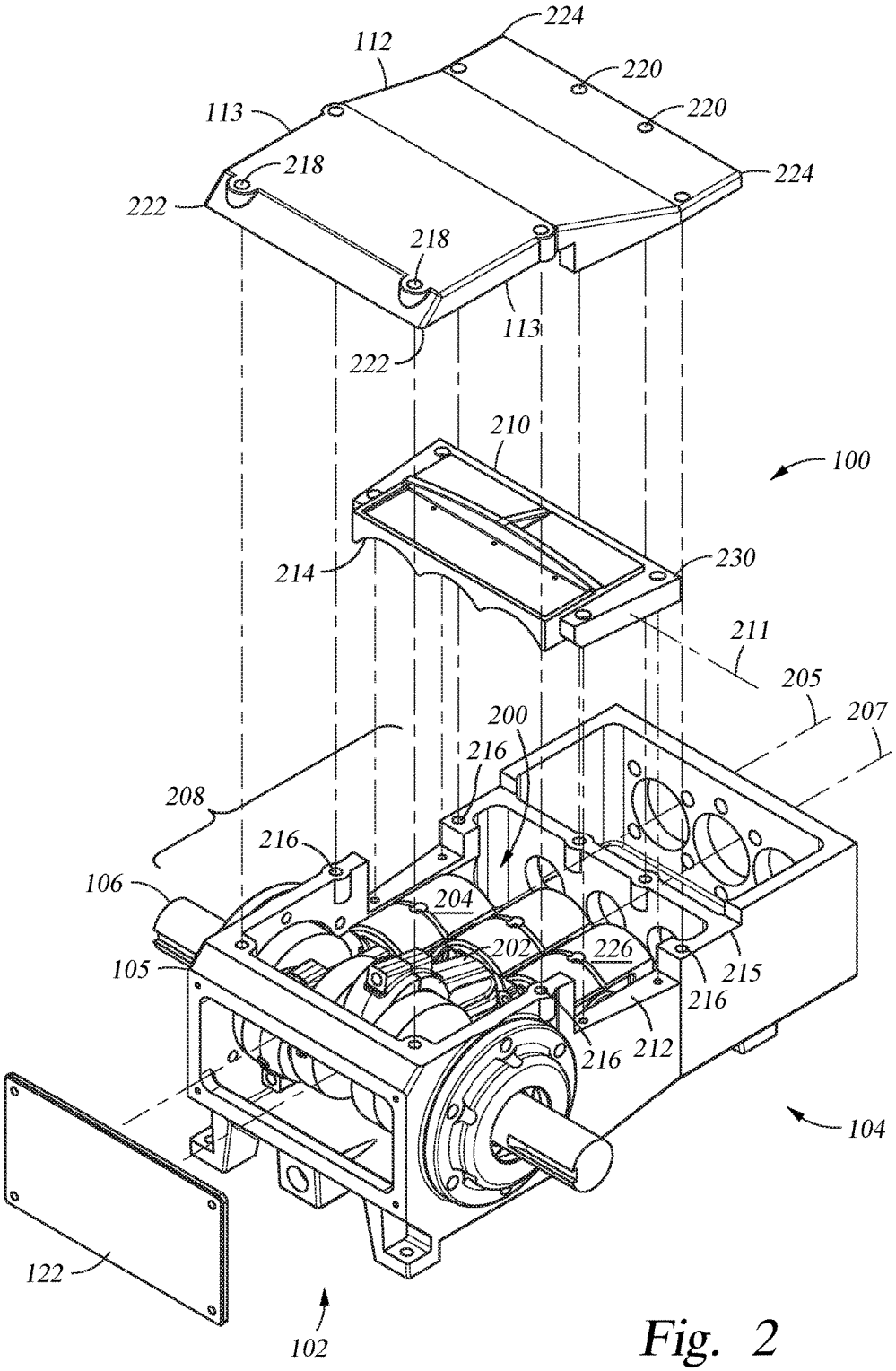
FIG. 2 is a perspective view of the pump of FIG. 1 the lid and end plate separated from the casing.

FIG. 2 is a perspective view of the pump 100 with the lid 112 and end plate 122 separated from the casing 110. The crankshaft 106 is visible inside the crankcase 105. The casing 110 defines a continuous operating cavity 200 that extends from the power end 102 to the fluid end 104, with no dividers positioned in the operating cavity 200. Control rods 202 are shown coupled to the crankshaft 106, and crossheads 204 are shown coupled to the control rods 202. The detachable lid 112 may be removed from the casing 110 to provide access to the control rods 202 and crossheads 204 so the control rods 202 and crossheads 204 may be removed or otherwise manipulated without removing the crankshaft 106 from the crankcase 105. This capability simplifies pump maintenance and repair.

The crankshaft 106, control rods 202, and crossheads 204 together define a reciprocating assembly 208 that is housed in the operating cavity 200. When the lid 112 is fastened in place, the operating cavity 200 is a continuous enclosure from the end plate 122 to the fluid end 104, with no walls, partitions, or dividers in the operating cavity 200. The stroke of the crossheads 204 defines an axis 205 of the pump parallel to the stroke of the crossheads 204. Each of the crossheads 204 travels along a stroke axis 207 aligned with the axis of the pump, and the crankshaft 106 is disposed transverse to the axis 205 of the pump. Alignment of the crossheads 204 is maintained by an alignment plate 210 that is fastened to the casing 110 in an orientation aligned with the axis 205 of the pump. A major axis 211 of the alignment plate 210 is oriented transverse to the axis 205 of the pump when the alignment plate 210 is installed, and the alignment plate 210 fastens to the sides of the pump casing 110 at a notch 212 in the sides of the pump casing 110. The notch 212 positions the alignment plate 210 such that alignment surfaces 214 of the alignment plate 210 are in close proximity to the crossheads 204 during operation.

The lid 112 is fastened to the casing 110 at the power end 102, at the fluid end 104, and at the sides 215 of the casing 110. Two fastening points 216 adjacent to the notch 212, on either side thereof, fasten the lid 112 to the side of the casing 110. A pair of such fastening points 216 are on each side of the casing 110. The lid 112 has two fastening points 218 at the power end 102 of the pump 100 and two fastening points 220 at the fluid end 104 of the pump. The fastening points 218 are located near the sides 113 of the lid 112 at the power end corners 222 of the lid 112. The fastening points 220 at the fluid end 104 of the pump are spaced apart from the fluid end corners 224 of the lid 112, and are located near a center line 226 of the lid 112.

The pump 100 is shown with three control rod/crosshead pairs coupled to three cycle points of the crankshaft 106, buy any number of pairs may be used with appropriate enhancement of the crankshaft 106. The stroke axis 207 of each control rod/crosshead pair extends substantially through the center of each crosshead 204. The stroke axis 207 of an outermost control rod/crosshead pair 226 is disposed between a fastening point 218 and a corresponding fastening point 220. The fastening point 218 and the fastening point 220 are on opposite sides of a plane defined by the stroke axis 207 of the outermost control rod/crosshead pair 226. The fastening points 218 and fastening points 220 are in the same geometric relationship with respect to the outermost control rod/crosshead pair 226 on either side of the pump 100.

Placement of the fastening points 218 and 220 in this relationship reduces twisting of the pump casing 110 and separation of the lid 112 from the casing 110 as stresses produced by stroking the crossheads 204 propagate through the pump 100. Each power stroke produces a downward thrust on the casing 110, which may be off-axis with respect to the pump casing 110. The off-axis power stroke causes a torque on the pump casing 110 that would engender separation of the lid 112 from the casing 110 but for the fasteners fastening the lid 112 to the casing 110 at the sides.

The alignment plate 210 has a flange 230 that fastens to the sides of the pump casing 110. The flange 230 has a thickness that substantially fills the notch 212 and provides a surface continuity with the portions of the pump casing 110 on either side of the notch, thus providing a flat surface for mating with the lid 112. Referring back to FIG. 1, the flange 230 of the alignment plate 210 is shown with a top surface 231 aligned with a top surface 232 of the casing 110 adjacent to the notch 212. The aligned surfaces 231 and 232 provide a flat surface for mating with the lid 112. If desired, a seal member may be disposed in a surface of the lid 112 for sealing against the surfaces 231 and 232 on either side of the pump 100. Additionally, the surfaces 231 and 232 may be uneven, and the lid 112 may be contoured at the sides 113 of the lid to follow and abut the surfaces 231 and 232.

Figure 3:
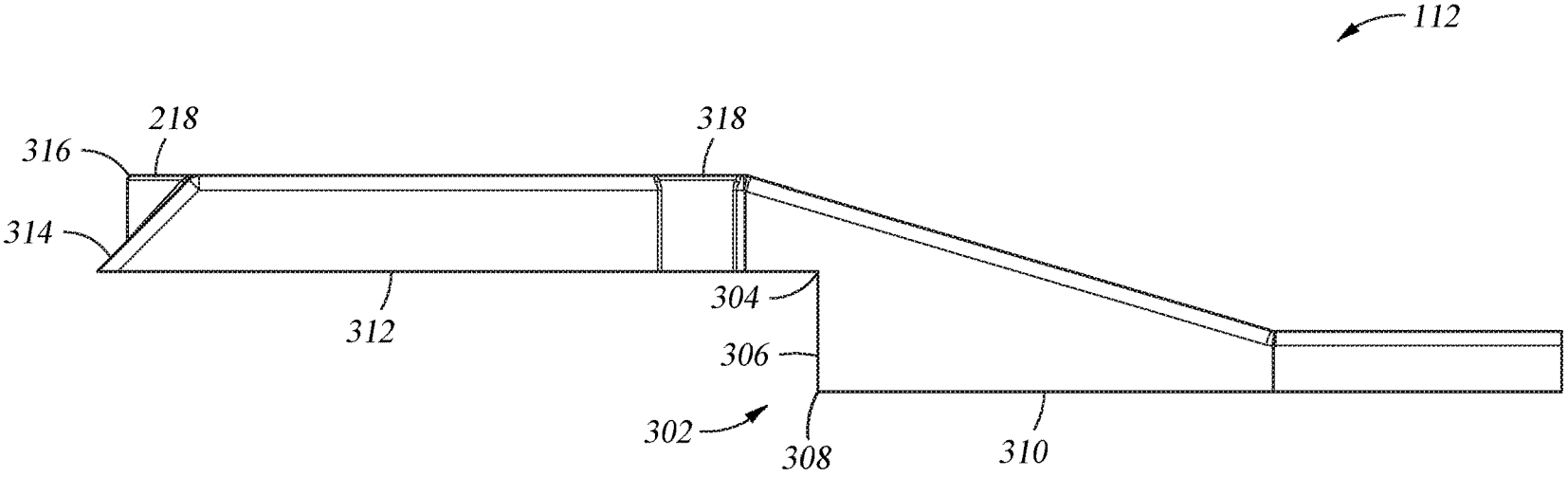
FIG. 3 is a side view of the lid.

FIG. 3 is a side view of the lid 112 according to one embodiment. The lid 112 has a corner section 302 that follows contours in the casing 110 (FIG. 1). A first corner 304 follows a transition in the casing 110 from the crankcase 105 to a mid-section of the casing 110 proximate to the control rods 202 (FIG. 2). A vertical surface 306 mates with a vertical surface of the crankcase 105. A second corner 308 mates with a corner where the vertical surface of the crankcase 105 meets the top surface 231 of the alignment plate 210, when the alignment plate 210 is installed in the notch 212. A lower surface 310 of the lid abuts the surfaces 231 and 232 of the alignment plate 210 and the casing 110. An upper abutment 312 of the lid abuts the portion of the casing 110 above the crankcase 105. The upper abutment 312, the vertical surface 306, and the lower surface 310 together press against the casing 110 to seal the operating cavity 200 against leakage.

The lid 112 has a bevel 314 that matches a corresponding bevel in the casing 110 at the power end 102 of the pump 100. The fastening points 218 are provided with fastening tabs 316 for convenient seating and optimal positioning of fasteners. Fastening tabs 318 are also provided for optimal positioning of fasteners to engage the fastening points 216 of the casing 110.

Figure 4:
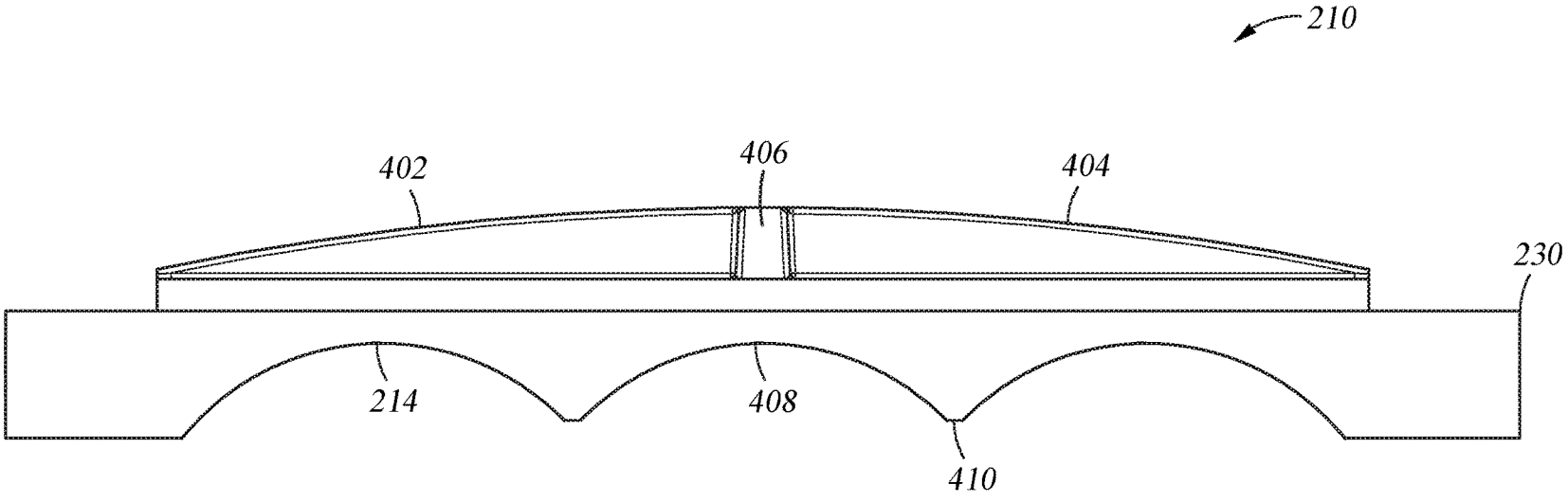
FIG. 4 is a side view of an alignment plate according to one embodiment.

FIG. 4 is an end view of the alignment plate 210 viewed from the fluid end. The flange 230 and the alignment features 214 are visible. Strength features 402 may be included in the alignment plate to provide additional strength to the entire pump structure during operation. The strength features 402 may include a transverse strength feature 404 and an axial strength feature 406 to provide enhanced strength along two axes. The alignment plate 210 has a thickness selected to provide a minimum strength at the thinnest parts of the plate 210. For example, at an apex 408 of each alignment feature 214, the thickness of the alignment plate 210 is at least about 100 mils.

The alignment plate 210 has a flat portion 410 between each alignment feature 214. The flat portion 410 results from the process of forming the alignment features 214. In one embodiment, a precursor to the alignment plate 214, which is a plate with a flat bottom, is attached to the pump casing 110. With the end plate 122 removed, a bore is then performed through the power end of the casing 110 to bore the alignment features 214 into the precursor plate to form the alignment plate 214. The bore process leaves the flat portions 410 between the alignment features 214. It should be noted that in some embodiments the flat portions 410 may be processed following the bore process to round or smooth the edges of the flat portions 410.

The alignment features 214 of the alignment plate 210 may be coated with a lubricant coating, such as Teflon, if desired. The alignment features 214 may also have a surface treatment, applied following the bore process described above, to increase smoothness of the alignment features.

Figure 5A:
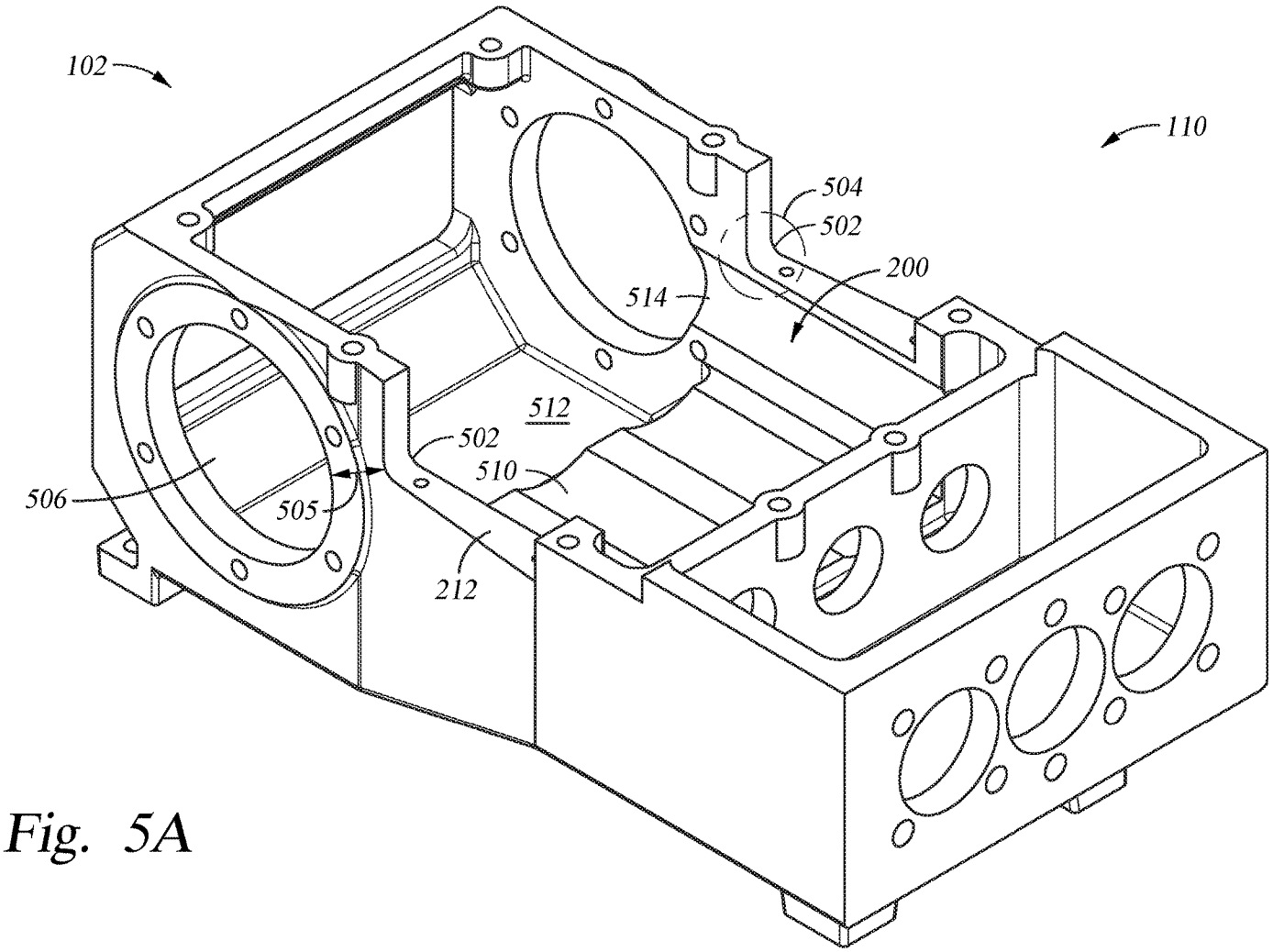
FIG. 5A is a perspective view of the casing of the pump of FIG. 1.

FIG. 5A is a perspective view of the casing 110 according to one embodiment. The casing 110 may have a curved surface 502 at a stress point 504. The casing 110 has an opening 506 through which the crankshaft 106 is disposed, and the stress point 504 is at a span 505 between the opening 506 and the curved surface 502. The curved surface 502 is provided to minimize the possibility of stress cracking due to cyclical stresses from the reciprocating assembly.

The curvature of the curved surface 502 is selected to provide stress reduction at the stress point 504 while maintaining the capability to seal the operating cavity 200. A minimum curvature is typically needed to ensure acceptable life of the casing 110. The minimum curvature depends on dimension of the span and thickness of the side of the casing 110. The size of the span 505 will scale with the size and power of the pump 100. In one embodiment the span will be from about 1 inch to about 2 inches, for example about 1.5 inches. The curvature of the curved surface 505 may be defined by a radius of curvature. In one embodiment, the radius of curvature of the curved surface 505 is from about 0 inches, in other words limited only by the tool used to make the curved surface, to about 0.75 inches, for example about 0.5 inches.

Figure 5B:
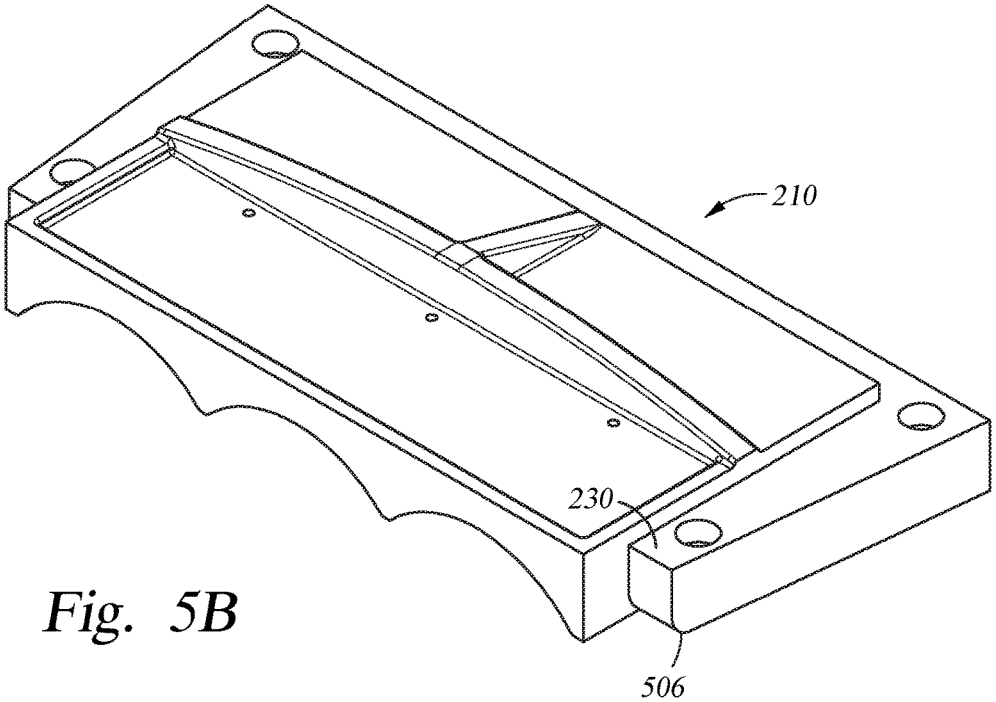
FIGS. 5B and 5C are perspective views of alternate embodiments of the alignment plate of FIG. 4.
Figure 5C:
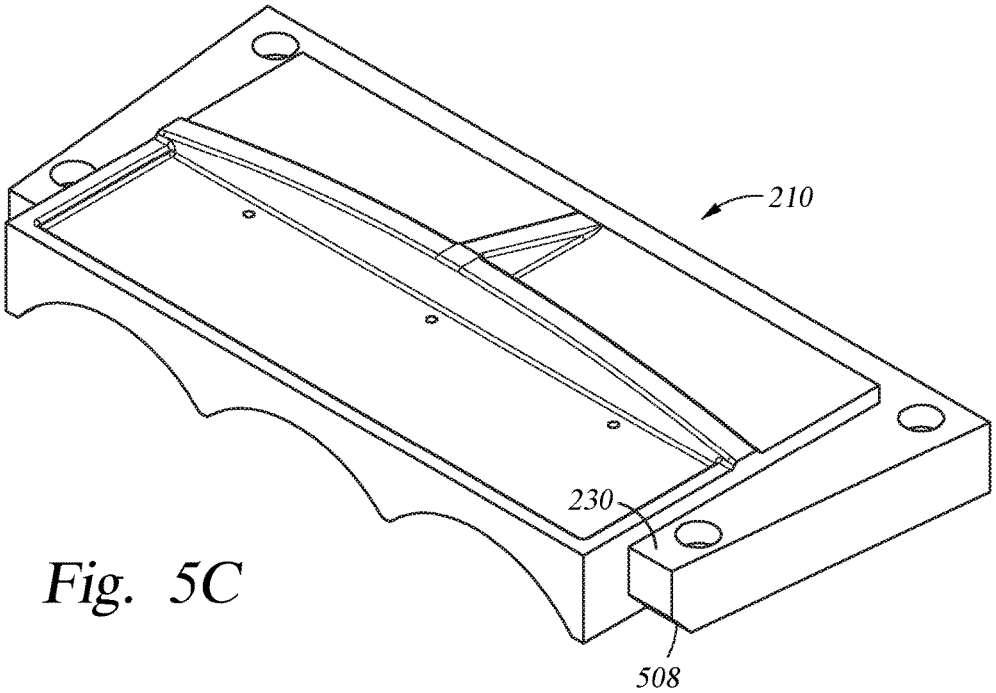

As noted above in connection with FIG. 2, the curved surface 502 defines a portion of the notch 212, in which the alignment plate 210 is fastened. The alignment plate 210 may have a curved portion 506 of the flange 230 for mating with the curved surface 502 of the notch 212, as shown in FIG. 5B, which is a perspective view of an alternate embodiment of the alignment plate 210. For ease of machining, the alignment plate 210 may alternately have a beveled portion 508 of the flange 230 for mating with the curved surface 502 of the notch 212, as shown in FIG. 5C, which is a perspective view of another alternate embodiment of the alignment plate 210. In the event a beveled alignment plate is used, a seal may be disposed between the beveled portion 508 and the curved surface 502 for sealing the opening between the two features. The seal may be pressure fit or adhesive bonded in the opening. The seal is typically a compliant material to maintain a seal under cyclical loading.

The casing 110 has alignment features 510 in a bottom wall 512 of the casing 110. The alignment features 510 cooperate with the alignment features 214 of the alignment plate 210 to maintain alignment of the crossheads 202 during operation. The alignment features 510 may be made in a way similar to the way the alignment features 214 are made. A precursor casing lacking the alignment features 510 may have the precursor plate to the alignment plate installed, and a bore process may be performed through the power end 102 of the casing 110. The bore process cuts through a portion of the bottom wall 512 and the alignment plate 210 to form the alignment features 214 and 510. As with the alignment features 214, the alignment features 510 may be coated with a lubricant coating, such as Teflon, or may have a surface treatment to increase smoothness. The sides 113 of the casing 110 may also have alignment features 514 formed in the same bore process.

The pump 100 provides improved access to the operating cavity 200 through use of a detachable lid 112. The operating cavity 200 is a continuous cavity, with no walls or dividers, and alignment of the crossheads 202 is maintained using an alignment plate 210 with alignment features 214, optionally in addition to alignment features 510, 514 in the bottom and sidewalls of the casing 110. Such features allow rapid maintenance and parts replacement without the need to remove the entire reciprocating assembly from the pump 100.

While the foregoing is directed to embodiments of the invention, other and further embodiments of the invention may be devised without departing from the basic scope thereof.

What is claimed is:

1. A pump, comprising:

a reciprocating assembly comprising a crankshaft, a plurality of control rods coupled to the crankshaft, and a plurality of crossheads coupled to the control rods, wherein the stroke of the crossheads define an axis of the pump, and the crankshaft is disposed transverse to the axis of the pump;

a casing with a continuous enclosure extending from a power end of the casing to a fluid end of the casing for housing the reciprocating assembly;

a detachable lid that fastens to the casing at the power end and at the fluid end; and a removable alignment feature aligned with the axis of the pump.

2. The pump of claim 1, wherein the lid has a first portion that covers the crankshaft and a second portion that covers the crossheads, and the first and second portions are non-coplanar.

3. The pump of claim 2, wherein the first portion and the second portion of the lid are connected by a third portion that forms an angle with the first portion and the second portion.

4. The pump of claim 3, wherein the alignment feature has a curved alignment surface for each crosshead.

5. The pump of claim 4, wherein the pump casing has a second alignment feature opposite each alignment surface of the alignment feature.

6. The pump of claim 5, wherein the alignment feature contacts a curved surface of the casing.

7. The pump of claim 6, further comprising a seal between the alignment feature and the casing.

8. The pump of claim 7, wherein the alignment feature has a curved surface that contacts a flat surface of the casing.

9. The pump of claim 1, wherein the alignment feature is an alignment member that fastens to the casing.

10. A pump, comprising:

a reciprocating assembly comprising a crankshaft, a plurality of control rods coupled to the crankshaft, and a plurality of crossheads coupled to the control rods, wherein the stroke of the crossheads define an axis of the pump, and the crankshaft is disposed substantially perpendicular to the axis of the pump;

a casing with a continuous enclosure extending from a power end of the casing to a fluid end of the casing for housing the reciprocating assembly;

a detachable lid that fastens to the casing at the power end and at the fluid end; and a removable alignment feature oriented substantially parallel to the axis of the pump, wherein the alignment feature has a curved alignment surface for each crosshead.

11. The pump of claim 10, wherein the pump casing has a second alignment feature opposite each alignment surface of the alignment feature.

12. The pump of claim 11, wherein the alignment feature contacts a curved surface of the casing.

13. The pump of claim 12, wherein the curved surface of the casing intersects a stress point of the casing.

14. The pump of claim 13, wherein the casing has an opening through which the crankshaft is disposed, and the stress point is a span between an edge of the opening and the curved surface.

15. The pump of claim 14, wherein the casing has two sides connecting the power end and the fluid end, and the lid fastens to the sides of the casing.

16. The pump of claim 10, wherein the lid has a first portion that covers the crankshaft and a second portion that covers the crossheads, and the first and second portions are non-coplanar.

17. The pump of claim 16, wherein the first portion and the second portion of the lid are connected by a third portion that forms an angle with the first portion and the second portion.

18. The pump of claim 10, wherein the alignment feature is an alignment member that fastens to the casing.

19. A pump, comprising:

a reciprocating assembly comprising a crankshaft, a plurality of control rods coupled to the crankshaft, and a plurality of crossheads coupled to the control rods, wherein the stroke of the crossheads define an axis of the pump, and the crankshaft is disposed substantially perpendicular to the axis of the pump;

a casing with a continuous enclosure extending from a power end of the casing to a fluid end of the casing for housing the reciprocating assembly and an alignment feature for each crosshead;

a detachable lid that fastens to the casing at the power end and at the fluid end; and a removable alignment feature oriented substantially parallel to the axis of the pump, wherein the alignment feature includes a curved alignment surface for each crosshead opposite each respective alignment feature of the casing, and the alignment feature contacts a curved surface of the casing located at a stress point of the casing.

20. The pump of claim 19, wherein the casing has two sides connecting the power end and the fluid end, and the lid fastens to the sides of the casing.

* * * * *